US007736542B2

(12) United States Patent
Shibata et al.

(10) Patent No.: US 7,736,542 B2
(45) Date of Patent: Jun. 15, 2010

(54) ELECTRON-EMITTING MATERIAL, MANUFACTURING METHOD THEREFOR AND ELECTRON-EMITTING ELEMENT AND IMAGE DISPLAYING DEVICE EMPLOYING SAME

(75) Inventors: Motoshi Shibata, Nara (JP); Masahiro Deguchi, Hirakata (JP); Akira Taomoto, Kyotanabe (JP); Toyokazu Ozaki, Nara (JP)

(73) Assignee: Panasonic Corporation, Osaka (JP)

( * ) Notice: Subject to any disclaimer, the term of this patent is extended or adjusted under 35 U.S.C. 154(b) by 1535 days.

(21) Appl. No.: 11/047,656

(22) Filed: Feb. 2, 2005

(65) Prior Publication Data

US 2005/0127334 A1 Jun. 16, 2005

Related U.S. Application Data

(63) Continuation of application No. PCT/JP2004/005703, filed on Apr. 21, 2004.

(30) Foreign Application Priority Data

Apr. 22, 2003 (JP) ..... 2003-116841

(51) Int. Cl.
*H01B 1/04* (2006.01)
*B05D 5/12* (2006.01)

(52) U.S. Cl. ..... 252/502; 427/113

(58) Field of Classification Search ..... 429/231.8; 252/502, 508, 506; 427/113, 122
See application file for complete search history.

(56) References Cited

U.S. PATENT DOCUMENTS 5,857,882 A 1/1999 Pam

FOREIGN PATENT DOCUMENTS

| | | |
|---|---|---|
| EP | 1 047 097 A1 | 10/2000 |
| JP | 04-37530 B2 | 6/1992 |
| JP | 4-37530 B2 | 6/1992 |
| JP | 2000-90813 | 3/2000 |
| JP | 2000-178016 | 6/2000 |
| JP | 2004-119263 | 4/2004 |

*Primary Examiner*—Jennifer Michener
*Assistant Examiner*—Monique Wills
(74) *Attorney, Agent, or Firm*—McDermott Will & Emery LLP

(57) ABSTRACT

In the present invention an electron-emitting material is provided wherein the field emission initiation voltage or work function is smaller than that of conventional materials. That is, the present invention relates to an electron-emitting sheet material which is a material comprising a substrate 102 and a graphite sheet 101 laminated on the top of the substrate 102, wherein (1) the graphite sheet 101 has a layered structure of layers of graphenes consisting of a plurality of carbon hexagonal networks, (2) the graphenes are layered relative to one another so that the c-axial direction of each graphene is substantially perpendicular to the plane of the substrate 102, (3) the graphite sheet 101 is laminated on top of the substrate 102 so that the c-axial direction of each graphene is substantially perpendicular to the plane of the substrate 102, and (4) the graphite sheet 101 comprises an element other than carbon as a second element.

40 Claims, 10 Drawing Sheets

ELECTRON-EMITTING MATERIAL, MANUFACTURING METHOD THEREFOR AND ELECTRON-EMITTING ELEMENT AND IMAGE DISPLAYING DEVICE EMPLOYING SAME

This application is a continuation of PCT/JP2004/005703, filed on Apr. 21, 2004.

TECHNICAL FIELD

The present invention relates to a field emission material for use in displays, cathode ray tubes, emitters, lamps, electron guns and the like, and to a manufacturing method therefor. Moreover, the present invention relates to an electron-emitting element and an image displaying device employing the field emission material.

BACKGROUND ART

In recent years greater demands have been made of display devices, including thinness, larger area and lower power consumption. In order to meet these demands, research is being done into the use of cold cathode electron sources, which have little heat loss at the electron source.

1991 saw the development of carbon nanotubes, a tubular carbon material with a diameter of tens of nm and a length of several μm. Before this development, many displays had been reported using so-called spint-type cold cathodes formed from metal in circular cone form (for example, *Journal of Applied Physics* Vol. 39, No. 7, p. 3504 (1968)). However, carbon nanotubes have not only the superior electrical conductivity, thermal conductivity and corrosion resistance of carbon material, but also an extremely small radius of curvature. Consequently, carbon nanotubes hold promise as highly efficient and sturdy emissive elements which are stable even in low vacuum. As a result, the main thrust of research and development has begun to turn towards carbon nanotubes (for example, *Applied Physics Letters* Vol. 78, No. 4, p. 539 (2001)).

In Japanese Unexamined Patent Publication No. 2000-178016 it is disclosed that an artificial graphite sheet can be obtained by two-stage baking of a polymer sheet. This graphite sheet has the high flexibility in addition to the superior electrical conductivity, thermal conductivity and corrosion resistance of the carbon material. And this graphite sheet is made from a polymer sheet. Accordingly, a sheet with a large area can be formed easily.

LIST OF OTHER REFERENCES RELATED TO THE PRESENT INVENTION (1) Japanese Unexamined Patent Publication No. H10-269929: In this publication a method is disclosed for manufacturing an emitter for electron emission which is made by irradiating an emitter constituent part consisting of photo resist (the part indicated by ref. no. 21 on the front page of the application) with ions of either argon, phosphorus, boron or carbon.

(2) U.S. Pat. No. 5,863,467 (Japanese Unexamined Patent Publication No. H11-1621): This patent is discussed below.

(3) Japanese Unexamined Patent Publication No. 2003-16908: In this publication an emissive element is disclosed having an emissive layer (the part indicated by ref. no. 5 in FIGS. 1 and 4(e) of the application) made of graphite or the like.

(4) Japanese Unexamined Patent Publication No. H10-1887788 (particularly paragraph 0066): In this publication an emissive element is disclosed wherein a plurality of emissive bodies (ref. no. 5 in FIGS. 1 and 2 of the application) each consisting of a carbon body (ref. no. 22) formed around a core of fine metal particles (ref. no. 21) and terminated via oxygen with a low-work-function material such as lithium (ref. no. 23) are lined up on an electrode (ref. no. 3). A related publication is Japanese Unexamined Patent Publication No. H11-40044.

(5) Japanese Unexamined Patent Publication No. S62-91413: In this publication a semi-metal or metal multi-layer material structure is disclosed consisting of layered graphite implanted with carbon ions in the c-axial direction.

(6) Japanese Unexamined Patent Publication No. 2001-288625: In this publication a graphite nanofiber material is disclosed having a columnar structure or the like in which graphite sheets (ref. no. 12 in FIG. 2 of the application) having the shape of an ice cream cone with the tip cut off are layered with a catalytic metal (ref. no. 14) therebetween. The use of this graphite fiber material as an electron emission source is also disclosed.

(7) Japanese Unexamined Patent Publication No. H2-174059: In this publication a cathode for a lithium solid electrolyte battery is disclosed having a graphite thin film with doped lithium ions, wherein the lithium ions are dedoped from a graphite compound thin film comprising lithium ions, which is then crystallized with the defects still present in the part with the lithium ions (8) Japanese Unexamined Patent Publication No. 2003-178669: In this publication, which was published subsequent to the application date (Apr. 22, 2003) for the priority application of the present invention (Application No. 2003-11641), a cold cathode device is disclosed which is obtained by intercalation in which an impurity such as Cs, Ba or the like is added to a graphite layer (ref. no. 403 in FIG. 4 of the application) by means of ion implantation or thermal diffusion. However, graphite obtained by laser annealing does not have a high crystallinity either between or within planes. Moreover, because a compound formed by intercalation is defined as $MC_{m \cdot n}$ (where m is 6 or 8) according to the type of impurity and the stage degree n, the impurity concentration is greater than 3%.

DISCLOSURE OF THE INVENTION

However, methods of producing nanotubes with a single structure cheaply and in large quantities are still in development. Moreover, no process has been established for forming a field emission part which is uniform across a large area and is stable over time.

On the other hand, graphite sheets have the superior electrical conductivity, thermal conductivity and corrosion resistance of carbon materials, and they can form large sheets of a uniform thickness. They are material suitable for forming large-area display devices and other electron-emitting parts. However, a large field emission initiation voltage is required because there are no structures on the surface with a radius of curvature as small as that of carbon nanotubes.

Along with the field emission initiation voltage, work function is an important value for evaluating the field emission characteristics. When the work function is small, it is possible to increase the current by small changes in voltage. However, the work function is determined by the electron states of the substances which contribute to field emission. Consequently, even if a structure with a radius of curvature equivalent to that of nanotubes is formed in carbon material containing graphite as the main component for example, performance surpassing that of carbon nanotubes cannot be obtained.

It is an object of the present invention to provide an electron-emitting material which has the superior electrical conductivity, thermal conductivity and corrosion resistance of a carbon material and is capable of providing a large-area display device with a low work function and field emission initiation voltage.

The present invention is directed to the following electron-emitting sheet material and manufacturing method therefor, and to an electron-emitting element and image displaying device employing same.

1. An electron-emitting sheet material comprising a substrate (102) and a graphite sheet (101) laminated on the top of the substrate (102), wherein (1) the graphite sheet (101) has a layered structure of layers of graphenes consisting of a plurality of carbon hexagonal networks, (2) the graphenes are layered relative to one another so that the c-axial direction of each graphene is substantially perpendicular to the plane of the substrate (102), (3) the graphite sheet (101) is laminated on the substrate (102) so that the c-axial direction of each graphene is substantially perpendicular to the plane of the substrate (102), and (4) the graphite sheet (101) comprises an element other than carbon as a second element.

2. The electron-emitting sheet material according to Claim 1, wherein the x-ray diffraction pattern of the graphite sheet has ($002^n$) plane peaks, wherein n is a natural number.

3. The electron-emitting sheet material according to above 1, wherein the x-ray diffraction pattern of the graphite sheet has (002) plane and (004) plane peaks.

4. The electron-emitting sheet material according to above 1, wherein the second element is present between the layers of graphenes.

5. The electron-emitting sheet material according to above 1, wherein the concentration of the second element is from 0.001 at % to 3 at %.

6. The electron-emitting sheet material according to above 1, wherein the concentration of the second element is from 0.005 at % to 2 at %.

7. The electron-emitting sheet material according to above 1, wherein the concentration of the second element is from 0.01 at % to 1 at %.

8. The electron-emitting sheet material according to above 1, wherein the thickness of the sheet is from 10 μm to 1000 μm.

9. The electron-emitting sheet material according to above 1, wherein some or all of the second element is present in the surface layer between the surface of the electron-emitting sheet material and a depth of 10% of the thickness of the electron-emitting sheet material.

10. The electron-emitting sheet material according to above 1, wherein the second element is at least one of an alkaline metal element and an alkaline earth metal element.

11. The electron-emitting sheet material according to above 1, wherein the second element is at least one of Li, Na, K, Cs, Rb, Ca, Sr and Ba.

12. The electron-emitting sheet material according to above 1, wherein the second element is at least one of nitrogen and oxygen.

13. The electron-emitting sheet material according to above 1, wherein the second element is at least one kind of noble gas element.

14. The electron-emitting sheet material according to above 1, wherein the second element is at least one of Ne, Ar, Kr and Xe.

15. The electron-emitting sheet material according to above 1, wherein the second element is a combination of 2 or 3 of 1) through 3) below;

1) at least one of an alkaline metal element and an alkaline earth metal element, 2) at least one of nitrogen and oxygen, 3) at least one kind of noble gas element.

16. A method for manufacturing an electron-emitting sheet material comprising a substrate (102) and a graphite sheet (101) laminated on the top of the substrate (102), wherein, (1) the graphite sheet (101) has a layered structure of layers of graphenes consisting of a plurality of carbon hexagonal networks, (2) the graphenes are layered relative to one another so that the c-axial direction of each graphene is substantially perpendicular to the plane of the substrate (102), and (3) the graphite sheet (101) is laminated on the substrate (102) so that the c-axial direction of each graphene is substantially perpendicular to the plane of the substrate (102), wherein the method comprises a step of imparting a second element other than carbon to the graphite sheet in the form of atoms, molecules or clusters.

17. The method for manufacturing an electron-emitting sheet material according to above 16, having a step of heat treating the graphite sheet after the step of imparting a second element.

18. The method for manufacturing an electron-emitting sheet material according to above 16, wherein the step of imparting a second element comprises a) an ion implantation step of implanting at least one of ionized atoms, molecules and clusters as the second element in the graphite sheet.

19. The method for manufacturing an electron-emitting sheet material according to above 16, wherein the step of imparting a second element comprises b) a radical irradiation step of irradiating the graphite sheet with at least one of radicalized atoms, molecules and clusters as the second element.

20. The method for manufacturing an electron-emitting sheet material according to above 16, wherein the step of imparting a second element comprises c) a deposition step of depositing at least one of electrically neutral substance in the form of atoms, molecules and clusters as the second element on the graphite sheet.

21. The method for manufacturing an electron-emitting sheet material according to above 16, wherein the step of imparting a second element has two or three of the following steps a) through c):

a) an ion implantation step of implanting at least one of ionized atoms, molecules and clusters as the second element in the graphite sheet.

b) a radical irradiation step of irradiating the graphite sheet with at least one of radicalized atoms, molecules and clusters as the second element.

c) a deposition step of depositing at least one of electrically neutral substance in the form of atoms, molecules and clusters as the second element on the graphite sheet.

22. The method for manufacturing an electron-emitting sheet material according to above 16, wherein the graphite sheet is obtained by heat-treatment of a polymer sheet.

23. The method for manufacturing an electron-emitting sheet material according to above 22, wherein the polymer sheet is at least one of polyphenylene oxadiazole, polybenzothiazole, polybenzobisthiazole, polybenzoxazole, polybenzobisoxazole, polythiazole, polyamide, polyimide, polyamide-imide and polyacrylonitrile.

24. The method for manufacturing an electron-emitting sheet material according to above 22, wherein the polymer sheet is polyimide.

25. The method for manufacturing an electron-emitting sheet material according to above 22, wherein the polymer sheet is aromatic polyimide.

26. The method for manufacturing an electron-emitting sheet material according to above 22, wherein the heat treatment comprises a first heat treatment step of heating in inactive gas from a first initial temperature at a first heating rate and baking at a temperature of not less than 1000° C. and less than 2500° C., and a second heat treatment step of heating after the first heat treatment step in inactive gas from a second initial temperature at a second heating rate and baking at a temperature of 2500° C. or more.

27. The method for manufacturing an electron-emitting sheet material according to above 16, wherein the x-ray diffraction pattern of the graphite sheet has ($002^n$) plane peaks, wherein n is a natural number.

28. The method for manufacturing an electron-emitting sheet material according to above 16, wherein the x-ray diffraction pattern of the graphite sheet has (002) plane and (004) plane peaks.

29. The method for manufacturing an electron-emitting sheet material according to above 16, wherein the second element is present between the layers of graphenes.

30. The method for manufacturing an electron-emitting sheet material according to above 16, wherein the concentration of the second element is from 0.001 at % to 3 at %.

31. The method for manufacturing an electron-emitting sheet material according to above 16, wherein the concentration of the second element is from 0.005 at % to 2 at % atomic.

32. The method for manufacturing an electron-emitting sheet material according to above 16, wherein the concentration of the second element is from 0.01 at % to 1 at %.

33. The method for manufacturing an electron-emitting sheet material according to above 16, wherein the thickness of the sheet is from 10 μm to 1000 μm.

34. The method for manufacturing an electron-emitting sheet material according to above 16, wherein some or all of the second element is present in the surface layer between the surface of the electron-emitting sheet material and a depth of 10% of the thickness of the electron-emitting sheet material.

35. The method for manufacturing an electron-emitting sheet material according to above 16, wherein the second element is at least one of an alkaline metal element and an alkaline earth metal element.

36. The method for manufacturing an electron-emitting sheet material according to above 16, wherein the second element is at least one of Li, Na, K, Cs, Rb, Ca, Sr and Ba.

37. The method for manufacturing an electron-emitting sheet material according to above 16, wherein the second element is at least one of nitrogen and oxygen.

38. The method for manufacturing an electron-emitting sheet material according to above 16, wherein the second element is at least one kind of noble gas element.

39. The method for manufacturing an electron-emitting sheet material according to above 16, wherein the second element is at least one of Ne, Ar, Kr and Xe.

40. The method for manufacturing an electron-emitting sheet material according to above 16, wherein the second element is a combination of 2 or 3 of 1) through 3) below;

1) at least one of an alkaline metal element and an alkaline earth metal element, 2) at least one of nitrogen and oxygen, 3) at least one kind of noble gas element.

41. An electron-emitting element comprising an electron-emitting sheet material, a conductive gate layer and an insulating layer, wherein the electron-emitting sheet material comprises a substrate (102) and a graphite sheet (101) laminated on the top of the substrate (102), and wherein (1) the graphite sheet (101) has a layered structure of layers of graphenes consisting of a plurality of carbon hexagonal networks, (2) the graphenes are layered relative to one another so that the c-axial direction of each graphene is substantially perpendicular to the plane of the substrate (102), (3) the graphite sheet (101) is laminated on the substrate (102) so that the c-axial direction of each graphene is substantially perpendicular to the plane of the substrate (102), and (4) the graphite sheet (101) comprises an element other than carbon as a second element, and wherein the graphite sheet (101) and conductive gate layer (106) are arranged with an insulating layer (105) therebetween.

42. A fluorescent light-emitting element comprising an electron-emitting element and an anode part having a fluorescent layer, in which the anode part and electron-emitting element are arranged so that electrons emitted by the electron-emitting element cause the fluorescent layer to emit light, wherein the electron-emitting element is the element of above 41.

43. An image displaying device comprising an anode part having a fluorescent layer and a plurality of electron-emitting elements arranged two-dimensionally, in which the anode part and electron-emitting elements are arranged so that electrons emitted by the electron-emitting elements cause the fluorescent layer to emit light, wherein the electron-emitting element is the element of above 41.

44. The image displaying device according to claim 43, wherein the amount of fluorescence is controlled according to the amount of electron emission from each of the plurality of electron-emitting elements.

LIST OF ELEMENTS

Figure 1:
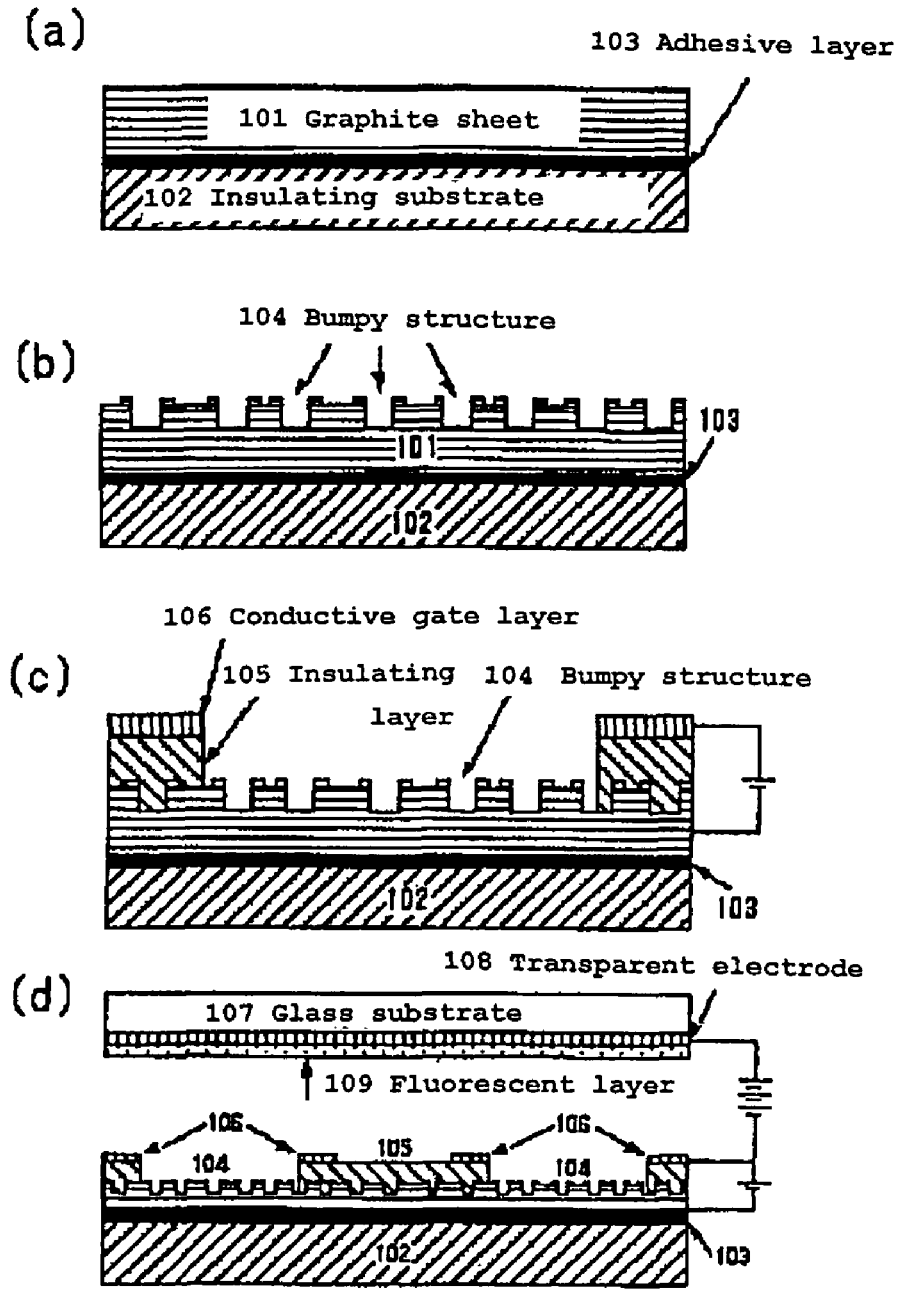
FIG. 1 is a process cross-section showing the electron-emitting material and manufacturing method in Example 1 of the present invention and an electron-emitting element employing same.

101 Graphite sheet
102 Insulating plate
103 Adhesive layer
104 Bumpy structure
105 Insulating layer
106 Conductive gate layer
107 Glass substrate
108 Transparent electrode
109 Fluorescent layer
401 Graphite sheet
402 Surface defect
403 Cs-impregnated region
501 Graphite sheet
502 Mo fine metal particles
503 Cs-impregnated region
504 Cs-impregnated region
606 Carbon atoms
607 Graphene structure
613 Molded body (graphite compression molded body, diamond sintered body)
614 Carbon material (graphite powder, diamond particles)
615 Highly-oriented graphite sheet
616 Graphene structure
701 Substrate
702 Electron supply layer (under-electrode)
703 Electron-emitting layer
706 Control electrode layer (conductive gate layer)
713 Fluorescent layer
714 Anode electrode layer
715 Front substrate
718, 719 Drivers

BEST MODE FOR CARRYING OUT THE INVENTION

Electron-Emitting Sheet Material

The electron-emitting sheet material of the present invention is a material comprising a substrate (102) and a graphite sheet (101) laminated on the top of the substrate (102), wherein (1) the graphite sheet (101) has a layered structure of layers of graphenes consisting of a plurality of carbon hexagonal networks, (2) the graphenes are layered relative to one another so that the c-axial direction of each graphene is substantially perpendicular to the plane of the substrate (102), (3) the graphite sheet (101) is laminated on top of the substrate (102) so that the c-axial direction of each graphene is substantially perpendicular to the plane of the substrate (102), and (4) the graphite sheet (101) comprises an element other than carbon as a second element.

(The Graphite Sheet)

Figure 6:
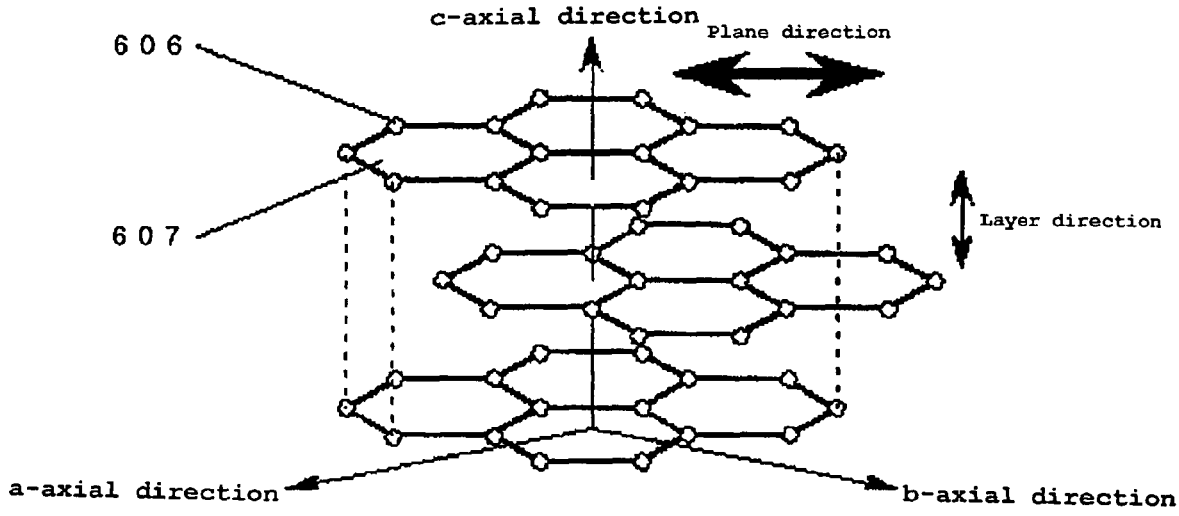
FIG. 6 shows the crystal structure of graphite.

As shown in FIG. 6, "graphite sheet" means a sheet having a layered crystal structure composed of layers of planar structures (graphene layer structures) 607 consisting of a plurality of carbon hexagons wherein the carbon hexagons are formed by carbon atoms 606.

The method of preparing this graphite sheet will be explained in more detail later, but in general it can be (1) a method of heat treating a polyimide or other polymer sheet or (2) a method of compression molding graphite particles together with a polymeric binder.

Since the graphenes are stacked in layers in the graphite sheets of both (1) and (2) above, the plane of the graphite sheet is roughly perpendicular to the c-axial direction of each graphene. In other words, the graphene layers are stacked so as to be roughly parallel to one another. Graphite sheets made by both methods (1) and (2) are commercially available.

In the electron-emitting sheet material of the present invention, the graphite sheet forms the electron emitting region. The graphite sheet is laminated on a substrate. In this case, the graphite sheet is laminated on the top of the substrate in such a way that the c-axial direction of each graphene making up the graphite sheet is substantially perpendicular to the plane of the plate-like substrate (102). In other words, the two are laminated so that the plane of the substrate is roughly parallel to each graphene layer.

The thickness of the graphite sheet of the present invention is not limited and can be set appropriately according to the intended purpose, the mode of use and the like. For example, when the use is as an electron-emitting element or the like it may normally be no less than 10 μm and no more than 1000 μm or especially no less than 50 μm and no more than 200 μm.

It is desirable that bumps be formed on the surface of the graphite sheet. The degree of bumpiness can be set appropriately according to the desired characteristics. In particular, it is desirable that the graphite sheet have the bumpy structure imparted by the manufacturing method described below. More particularly, it is desirable that 1) bumps formed by implantation of ionized atoms, molecules or clusters in the graphite sheet, 2) bumps formed by irradiating the graphite sheet with atoms, molecules or clusters, or 3) bumps formed by depositing electrically neutral atoms, molecules or clusters on the graphite sheet be formed on the surface of the graphite sheet.

The substrate can be made from known materials. For example, an insulating material such as glass, quartz, ceramics (oxide ceramics such as $Al_2O_3$ or $ZrO_2$, non-oxide ceramics such as $Si_3N_4$ and BN) or the like or a conductive material such as low-resistance silicon or a metal, alloy or intermetallic compound can be used. The thickness of the plate is not limited but can normally be from about 0.5 mm to 2 mm.

The substrate and graphite sheet may have another layer therebetween or no layer therebetween. The intervening layer may be an adhesive layer, electrode layer (lower-electrode) or the like.

(The Second Element)

The type of second element can be selected appropriately from the elements other than carbon according to the desired sheet characteristics.

For example, at least one of an alkaline metal element and an alkaline earth metal element can be used as the second element. In particular, at least one of Li, Na, K, Cs, Rb, Ca, Sr and Ba can be used by preference. When alkaline metal elements and alkaline earth metal elements are chemically or physically adsorbed between layers or on the surface of graphite, the work function decreases and electron emission can be initiated at a lower voltage.

For example, at least one of nitrogen and oxygen can be used as the second element. Nitrogen and oxygen are not only chemically or physically adsorbed between layers or on the surface of graphite, but are capable of controlling electronic states by binding with or replacing carbon atoms.

For instance, at least one kind of noble gas can be used as the second element. In particular, at least one of Ne, Ar, Kr and Xe can be used favorably. Noble gas elements do not react with carbon atoms, but are capable of altering the electronic state of graphite when they are present in or between layers of graphite.

A combination of 2 or 3 of 1) through 3) below:

1) At least one of an alkaline metal element and an alkaline earth metal element,
2) At least one of nitrogen and oxygen, and
3) At least one kind of noble gas may preferably be used as the second element in the electron-emitting sheet material of the present invention. Using a combination of these allows the electronic state of the graphite to be controlled more effectively. In particular, when a combination of these is used dipole polarization forms between neighboring atoms of different kinds, thus changing the electronic state of the graphite and reducing the work function so that electron emission is initiated at a lower voltage.

The contained amount of the second element can be determined appropriately according to the type of second element, the desired sheet characteristics and the like, but may normally be no less than 0.001 at % and no more than 3 at % or particularly no less than 0.005 at % and no more than 2 at % or more particularly no less than 0.01 at % and no more than 1 at % of the graphite sheet.

The second element may be present anywhere in the sheet material, but may preferably be on the surface of the sheet. More specifically, it is desirable that it be present in the surface layer between the surface of the sheet and a depth of 10% (particularly 1%) of the thickness of the sheet from the surface (hereunder sometimes called simply the "surface layer"). For example, if the sheet is 100 μm thick the second element may be located within the area up to a depth of 1 μm from the surface of the sheet. When the contained amount of the second element in the surface layer is within the aforementioned range, no graphite interlayer compounds will form, and because the second element is chemically or physically adsorbed between the layers or on the surface of the graphite, the electronic state on or near the surface of the graphite can altered and the work function value decreased. If the concentration of the second element is too low the work function will decrease less, becoming extremely close to that of the original graphite.

If the contained amount of the second element is within the aforementioned range the mechanical properties and thermal properties of the original graphite can be retained. Thus, due to the excellent electrical conductivity, thermal conductivity and the like of the graphite an electron-emitting element can be provided which undergoes little heating from joule heat even with a large current, which has rapid thermal diffusion and excellent sputtering resistance against positive ions, and which does not decline in performance even in low vacuum.

<Method for Manufacturing Electron-Emitting Sheet Material>

The electron-emitting sheet material of the present invention can be manufactured in any way as long as a configuration such as that described above is obtained. In particular, the electron-emitting sheet material of the present invention can be obtained favorably by a manufacturing method having a step of contributing a second, non-carbon element to the graphite sheet as atoms or molecules or clusters of these.

(Manufacturing the Graphite Sheet)

A known or commercial graphite sheet can be used as the graphite sheet (one not containing the second element). A graphite sheet obtained by known manufacturing methods can also be used. In particular, a sheet obtained by heat treatment of a polymer sheet can be used favorably. There are no limits on the polymer sheet as long as it yields graphite when heat treated, and at least one of polyphenylene oxadiazole, polybenzothiazole, polybenzobisthiazole, polybenzoxazole, polybenzobisoxazole, polythiazole, polyamide, polyimide, polyamide-imide and polyacrylonitrile can be used favorably. Of these, polyimide is preferable, and aromatic polyimide is more preferable. For example, in the case of aromatic polyimide, it is desirable to perform a 2-stage heat treatment step in which the sheet is heat-treated (pre-baked) in inactive gas by raising the heat from room temperature to a temperature of 1000° C. or more at which the polymer begins to thermally decompose, becoming a carbon precursor and then about 100% carbonized material, and is then heat-treated (main-baked) by raising the temperature from room temperature to a temperature of 2500° C. or more at which graphitization is completed. A foaming state can be formed more reliably in a graphite sheet obtained in this way than in one that does not undergo such a heat treatment step. The maximum temperature, heating speeds and the like for the pre-baking and main-baking can be determined appropriately according to the type of polymer and the like, depending on the thickness, density, surface state and the like of the graphite sheet. This polyimide sheet can provide a graphite structure better than that of any other aromatic condensed polymer sheet.

The thickness of the polymer sheet is not limited and can be set so as to obtain the target thickness of the electron-emitting sheet material of the present invention. In general it can be from about 5 μm to 300 μm or preferably from 25 μm to 125 μm.

The heat treatment conditions can be set so as to obtain the specified graphite structure. In general, the heat treatment temperature can be determined appropriately in the range of from 1000° C. to 3000° C. and the heat treatment time is from 10 minutes to 600 minutes in inactive gas.

More particularly, a method can be preferably employed consisting of a first heat treatment step in which the temperature is raised in inactive gas from a first starting temperature at a first heating speed and baking is performed at 1000° C. or more and less than 2500° C., and a second heat treatment step in which following the first heat treatment step the temperature is raised in inactive gas from a second starting temperature at a second heating speed and baking is performed at a temperature of 2500° C. or more. In this heat treatment step unnecessary constituent atoms in the graphite sheet are removed by thermal decomposition and gasification, and a graphite sheet with a large area and uniform material properties can be reliably formed at low cost.

The heating speed can be determined appropriately according to the type, thickness and the like of the sheet (resin) used. The first heating speed may normally be no less than 1° C./minute and no more than 20° C./minute or particularly no less than 5° C./minute and no more than 10° C./minute. The second heating speed may normally be no less than 1° C./minute and no more than 20° C./minute or particularly no less than 5° C./minute and no more than 10° C./minute.

The electron-emitting sheet material of the present invention can be favorably obtained by imparting a second element as atoms or molecules or clusters of these to a sheet obtained in this way.

Figure 7:
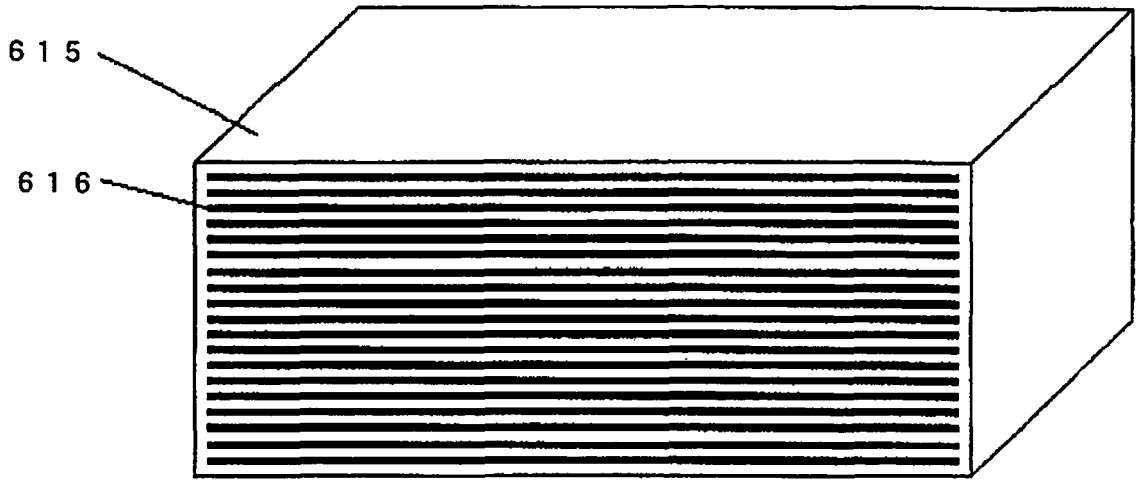
FIG. 7 is a typical view of the graphene structure of a graphite sheet.

An image of such a graphite sheet is shown in FIG. 7. This graphite sheet 615 consists of a plurality of stacked layers of graphenes 616.

Figure 8:
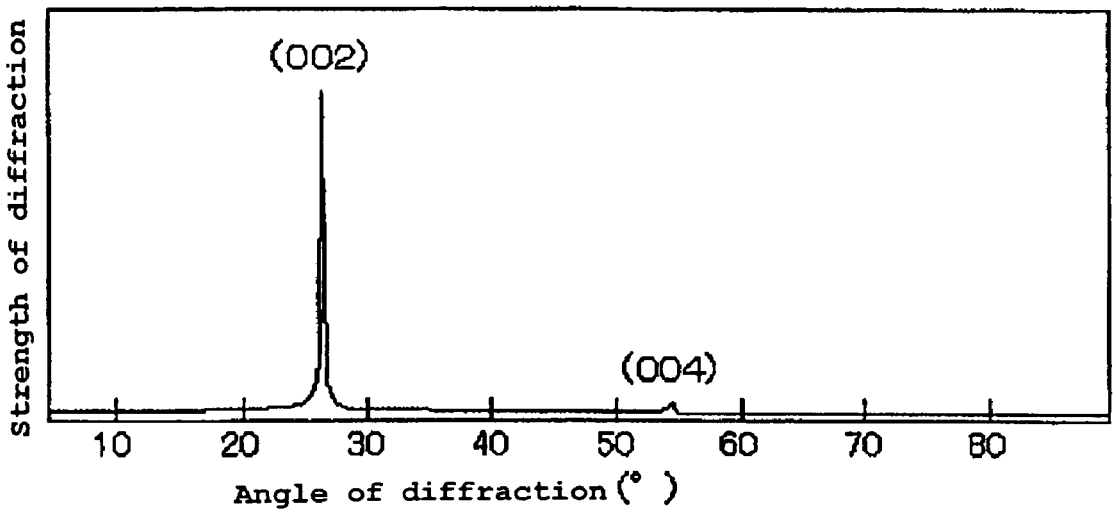
FIG. 8 shows a typical x-ray diffraction pattern of graphite.

Moreover, as shown in the x-ray diffraction pattern of FIG. 8, such a graphite sheet has peaks at (002″) (where n is a natural number). Specifically, it has peaks only at (002″) (where n is a natural number). Typically, it has peaks only at (002) and (004). The angle of diffraction of (002) when n=1 is approximate 26.5°.

Figure 9:
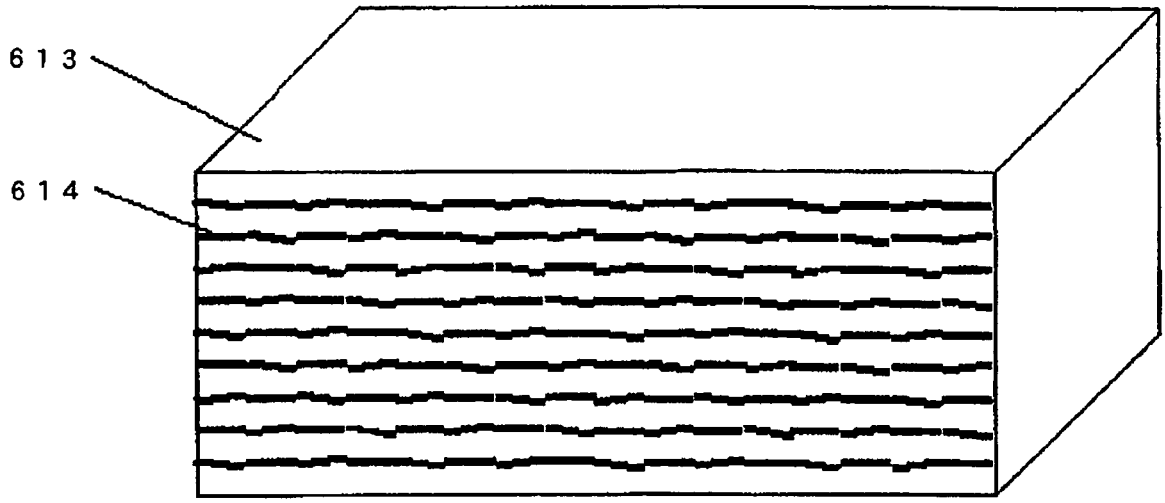
FIG. 9 is a typical view of the layered composition of a conventional graphite sheet.

In addition to the graphite sheet described above, the method for manufacturing the graphite sheet used in the present invention may be a method of compression molding graphite particles (graphite flakes) together with a polymeric binder. This is explained in detail in Japanese Unexamined Patent Publication No. H11-1621 (U.S. Pat. No. 5,863,467, which is cited in the present Description). The polymeric binder may be an epoxy resin. The filling ratio of graphite particles to polymeric binder may be 6:4 for example. An image of such a graphite sheet is shown in FIG. 9. As shown in FIG. 9, graphite particles 614 are arranged in layers in this sheet 613. The pressure for compression molding may be for example no less than 1400 psi and no more than 16000 psi. Unlike in FIG. 8, the x-ray diffraction pattern of such a graphite sheet has peaks here and there, so that it may be called "broad".

(Imparting the Second Element)

There are no particular limits on the method of imparting the second element as long as the second element can be fixed on the graphite sheet. Known methods can be employed as appropriate. In particular, in the present invention the second element is imparted in the form of atoms, molecules and clusters of these. The second element may be imparted either before lamination of the graphite sheet on the plate, or after lamination of the graphite sheet on the plate. The second element may be imparted either as a single element or as a compound (molecule) of two or more elements, but it is particularly desirable that it be imparted in the form of atoms, molecules or clusters of the second element alone.

In particular, it is desirable to employ at least one of the following steps a) through c):

a) A step of implanting at least one of ionized atoms and molecules and clusters of these as the second element in the graphite sheet (ion implantation step),
b) A step of irradiating the graphite sheet with at least one of radicalized atoms and molecules and clusters of these as the second element (radical exposure step), or
c) A step of depositing at least one of electrically neutral atoms and molecules and clusters of these as the second element on the graphite sheet (a step of causing neutral substance to reach).

Preferably, two or more steps can be employed. By performing two or more steps, because a bumpy structure has already been formed on the surface of the graphite sheet in the first manufacturing step, chemical or physical adsorption and dissociation on the surface or between layers of the graphite and reaction between the carbon atoms which constitute the graphite can be easily advanced in the second manufacturing step.

A known method such as for example a method of first using a known ionization device to ionize a vapor phase of atoms, molecules or clusters comprising the second element and then performing mass spectrometry to derive the specified ion atoms, molecules or clusters can be used by preference as the aforementioned method a). With this method, bumpy structures can be formed on the surface of a graphite sheet by bombarding the surface of the sheet with ionized atoms or molecules or clusters of these so that they penetrate the sheet. Because a bumpy structure produced by ion irradiation includes a high density of protruding structures with a small radius of curvature, a field emission part capable of emitting electrons at a low applied voltage is formed on the surface of the graphite sheet exposed to the ions. In ion implantation, moreover, the surface form and concentration distribution in the substance can be controlled by varying the atomic species, acceleration voltage, amount of implantation and the like.

A known method such as for example a method of irradiating a vapor phase of atoms, molecules or clusters comprising the second element with electromagnetic waves in the rf band can be used by preference as the method b). Radicals undergo less change in atom position due to collision than do ions, but have excellent chemical reaction activity. Consequently, when a graphite sheet is irradiated with radicalized atoms or molecules or clusters of these, the atoms or molecules or clusters of these are chemically or physically adsorbed between layers or on the surface of the graphite to form bumpy structures. Bumpy structures are also formed by sublimation or aggregation of reaction products with the carbon atoms which constitute the graphite. The bumpy structures produced by radical exposure include a high density of protruding structures with a small radius of curvature so that static concentration occurs easily. That is, a field emission part is formed on the surface of the graphite sheet exposed to radicals so that electrons can be emitted at low applied voltage.

The method disclosed in Japanese Unexamined Patent Publication No. H8-168961 for example can be used as the aforementioned method c). According to this method, electrically neutral atoms or molecules or clusters of these are brought to the graphite sheet so that they are deposited on the graphite surface, allowing the formation of bumpy structures with a small radius of curvature. An electron-emitting part can be formed favorably in this way.

Bumpy structures or carbon compounds are also formed when atoms or molecules or clusters of these which reach the graphite surface are chemically or physically adsorbed on the surface or between layers of graphite, and react with the carbon atoms which constitute the graphite. The bumpy structures have a small radius of curvature and their structure becomes the field emission part. The electronic condition near the surface can also be varied because of the presence of surface adsorbed material, atoms and clusters which penetrate the graphite, carbon compounds and the like.

(Heat-Treatment after Contribution of the Second Element)

In the present invention, the sheet with the contributed second element may also be heat-treated if necessary. It is possible by this heat treatment to promote chemical reactions between the graphite and the second element near the surface, make bumpy structures and compounds uniform within a plane, and control or make uniform the concentration distribution of the atoms or molecules or clusters of these in the direction of depth.

The heat-treatment conditions are not limited, and for example may be from about 5 to about 60 minutes at a temperature of no less than 300° C. and no more than 1000° C. in inactive gas.

<Electron-Emitting Element>

The electron-emitting element of the present invention is an electron-emitting element comprising an electron-emitting sheet material, a conductive gate layer and an insulating layer, wherein the electron-emitting sheet material is a material comprising a plate (102) and a graphite sheet (101) laminated on the plate (102), and wherein (1) the graphite sheet (101) has a layered structure of layers of graphenes consisting of a plurality of carbon hexagonal networks, (2) the graphenes are layered relative to one another so that the c-axial direction of each graphene is substantially perpendicular to the plane of the plate (102), (3) the graphite sheet (101) is laminated on top of the plate (102) so that the c-axial direction of each graphene is substantially perpendicular to the plane of the plate (102), and (4) the graphite sheet (101) comprises an element other than carbon as a second element, and wherein the graphite sheet and conductive gate layer are arranged with the insulating layer therebetween.

That is, apart from the use of the electron-emitting sheet material of the present invention as the electron-emitting region, elements (spacers and the like) which are used in known field emission elements can be employed in the electron-emitting element of the present invention. An example of the electron-emitting element of the present invention is shown in FIG. 1(*c*).

The electron-emitting region is formed by an electron-emitting sheet material which comprises insulating substrate plate 102 and graphite sheet 101. In FIG. 1(*c*), the plate-like substrate and graphite sheet are layered with adhesive layer 103 therebetween.

The substrate can be selected appropriately from known materials. For example, an insulating material such as glass, quartz, ceramics (oxide ceramics such as $Al_2O_3$ or $ZrO_2$, non-oxide ceramics such as $Si_3N_4$ and BN) or the like, or a conductive material such as low-resistance silicon or a metal, alloy or intermetallic compound can be used. The thickness of the plate is not limited but can normally be from about 0.5 mm to 2 mm. A commercial conductive adhesive or the like can be used as the adhesive. The thickness of the adhesive layer when an adhesive is used can be set appropriately according to the type of adhesive and the like.

A lower electrode layer which supplies electrons to the electron-emitting region can be formed as necessary in the electron-emitting element of the present invention. That is, an lower electrode layer can be formed between the substrate and the electron-emitting region. A metal material such as aluminum, titanium, chromium, nickel, copper, gold tungsten or the like or a composite material consisting of a metal layered with a low-resistance n-type semiconductor such as lithium nitride or the like can be used as the lower electrode layer. The thickness of the lower electrode layer can normally be from about 1 to 50 μm.

Conductive gate layer 106 supplies an electrical field to the electron-emitting layer when voltage is applied, and serves to control the amount of electrons emitted according to the strength of the field. The material is not limited as long as it has this function. In particular, a metal with abundant working properties such as adhesiveness with the adjoining layers, patterning and the like can be used by preference. In general, silver, copper, aluminum, nickel or the like can be used favorably. The thickness of the conductive gate layer can normally be from about 0.1 to 3 μm.

Any arrangement can be adopted in the electron-emitting element of the present invention as long as the electron-emitting region (particularly graphite sheet 101 of the electron-emitting sheet material of the present invention) and conductive gate layer 106 do not contact each other. At least one of space or an insulating body may be put between the electron-emitting region and the conductive gate layer. For example, as in FIG. 1(*c*), graphite sheet 101 can be arranged facing conductive gate layer 106 with an insulating layer 105 in between. Specifically, an arrangement in the same manner as that of the gate electrode and emitter in a known spint-type electron emitting device can be employed. The aforementioned space is preferably a vacuum or near-vacuum. The distance between the two layers can be determined appropriately according to the desired properties, the strength of the electrical field and the like. In general, the shorter the aforementioned distance the less voltage is required. It is desirable that the electron-emitting region (electron-emitting layer) and conductive gate layer be substantially parallel to each other.

That "the electron-emitting region and conductive gate layer do not contact each other" means that the electron-emitting region and conductive gate layer 106 are separate, and insulation is maintained between the two, as shown for example in FIG. 1(*c*).

The electron-emitting region and conductive gate layer 106 can be installed independently. They can be fixed with a spacer (insulator) therebetween. An insulating material such as alumina, zirconia, silicon dioxide or the like for example can be used favorably as the spacer.

The electron-emitting element of the present invention can be driven in the same way as known electron-emitting elements. For example, a specific voltage can be applied to a conductive gate layer and an lower electrode layer or electron-emitting region on a substrate. The voltage can be adjusted so as to subject the electron-emitting region to a field with a field strength of $1\times10^6$ V or more. In this case, the drive atmosphere may generally be a vacuum or near-vacuum. The drive temperature is not limited but may normally be set to from about 0 to 60° C. The current can be either direct or pulse (rectangular waves).

<Fluorescent Light-Emitting Element>

The fluorescent light-emitting element of the present invention comprises an electron-emitting element and an anode part having a fluorescent layer, with the anode part and electron-emitting element arranged so that electrons emitted by the electron-emitting element cause the fluorescent layer to glow, wherein the electron-emitting element is the electron-emitting element of the present invention.

The fluorescent light-emitting element of the present invention uses the electron-emitting element of the present invention as its electron-emitting element. Elements used in known fluorescent light-emitting elements can be employed for the other elements (container or housings and the like). An example of the fluorescent light-emitting element of the present invention is shown in FIG. 1(*d*).

A layered body consisting of fluorescent layer 109 closest to the electron-emitting element followed by transparent electrode (anode electrode layer) 108 and glass plate 107 can be used favorably as the basic configuration of the anode part. The configuration and formation of each layer can be in accordance with known technology.

When light emission is obtained from the front surface (anode part), transparent material used in known fluorescent light-emitting elements can be employed for the various layers making up the anode part. A glass plate, quartz plate or the like can be used for the plate. Examples of the anode electrode layer include indium tin oxide (ITO), tin oxide, zinc oxide and the like.

Fluorescent layer 109 can be formed as appropriate according to the desired colors and the like. That is, it can be selected as appropriate from the various fluorescent material (compounds) according to the three colors red (R), blue (B) and green (G) and intermediate colors thereof and the like. Examples include red fluorescent material such as $Y_2O_3$ and $GdBO_3$, green fluorescent material such as ZnS and ZnO and blue fluorescent material such as $Y_2SiO_5$ and ZnS. The fluorescent layer can be formed for example by printing or painting a solution or dispersion of these to form a thin film on transparent electrode 108.

The electron-emitting element and anode part (especially the fluorescent layer) can be arranged so that electrons emitted by the electron-emitting region of the element collide with the fluorescent layer of the anode part, causing it to glow. Preferably, the electron-emitting region and anode part (fluorescent layer) are arranged facing each other. It is desirable that there be a space (particularly a vacuum space) between the two. It is also desirable that the electron-emitting region (electron-emitting layer) and fluorescent layer be arranged parallel to one another. The distance between the electron-emitting region and fluorescent layer can be changed appropriately according to the desired properties and the like within the range of normally 100 μm to 2 mm.

<Image Displaying Device>

The image displaying device of the present invention comprises an anode part having a fluorescent layer and a plurality of electron-emitting elements arranged two-dimensionally, wherein the anode part and electron-emitting elements are arranged so that electrons emitted by the electron-emitting elements cause the fluorescent layer to glow, and wherein the electron-emitting elements are electron-emitting elements of the present invention.

In this image displaying device, electrons from the electron-emitting regions arrive near the gate electrodes, they are accelerated by voltage applied between the fluorescent layer and the gate electrodes, so that the fluorescent layer is illuminated by exposure to the electrons. The brightness of the light emitted can be controlled by the voltage applied to the gate electrodes. By controlling the gate electrode voltages of the individual electron-emitting elements it is possible to achieve a image displaying device in which pictures and words are displayed over a large area.

Figure 10:
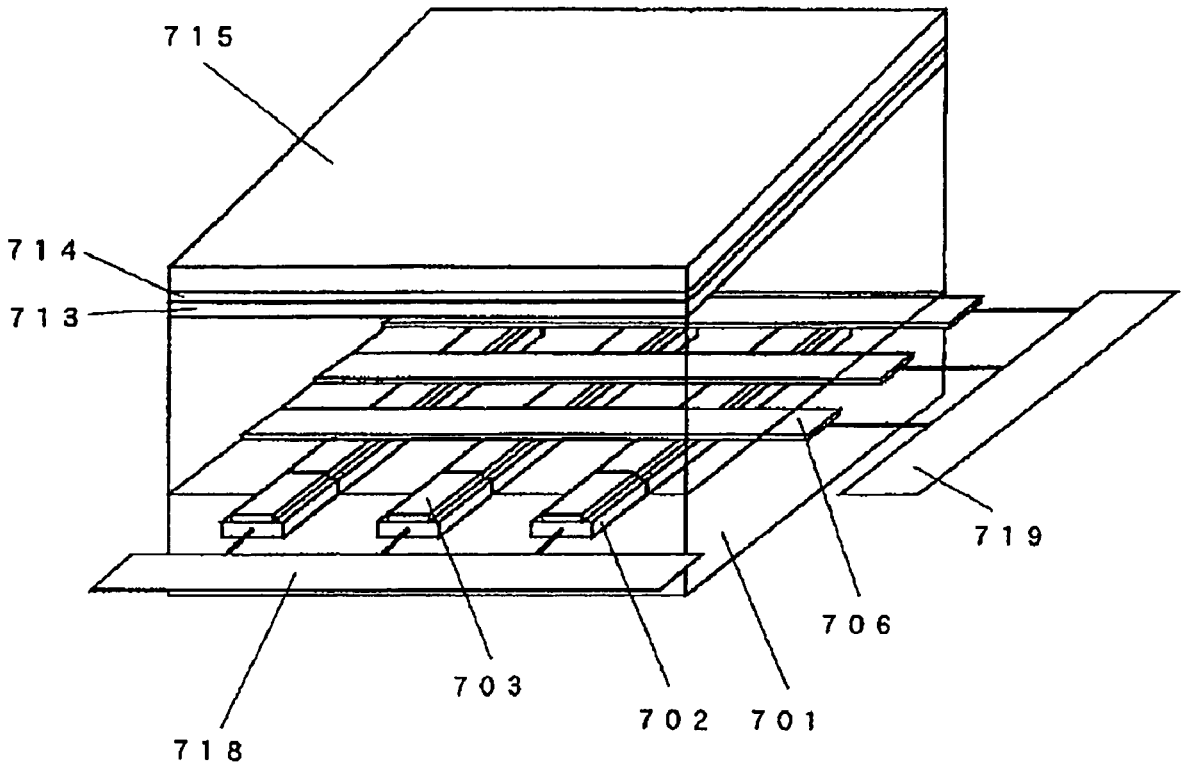
FIG. 10 is a tilted cross-section showing one example of a image displaying device having a plurality of electron-emitting elements arranged two-dimensionally.

The image displaying device of the present invention uses electron-emitting elements of the present invention as the electron-emitting elements. Elements used in known image displaying devices can be used for the other elements (housings, drivers and the like). An outline of the image displaying device of the present invention is shown in FIG. 10.

A plurality of electron-emitting elements 703 are arrayed two-dimensionally. That is, electron-emitting elements are laid out on the same plane to form an array of electron-emitting elements. For this array, a configuration (that is, matrix type) having a pattern of a plurality of conductive gate layers 706 orthogonal to a pattern of a plurality of electrodes which are electrically insulated for example is useful for manufacturing a large-screen device.

A configuration of the fluorescent layer of the fluorescent light-emitting element can be adopted for the basic configuration of the fluorescent layer. The number and types of fluorescent layer depends on the number of pixels, size of the picture and the like. The number of electron-emitting elements corresponding to one pixel differs depending on the desired brightness and the like but can normally be about 1 to 50.

In particular, in the case of a color picture display, each fluorescent layer having the three colors RGB as a group (1 pixel) can be arranged on the anode electrode so as to correspond to an electron-emitting element 703. Various arrangements can be adopted for the three fundamental colors, such as vertical stripes, horizontal stripes and the like. In the case of a color picture, the number of electron-emitting elements corresponding to one pixel is normally about 1 to 100.

The layout of each electron-emitting element 703 and anode part 714, which comprises fluorescent layer 713, can be arranged so that the amount of light emitted by each individual fluorescent layer can be controlled by means of the amount of electrons emitted by each electron-emitting element 703. In particular it is desirable that it be configured so that all or part of the fluorescent layers of the anode part and the electron-emitting regions of the electron-emitting element face each other with both layers being maintained substantially parallel to one another.

The method for driving the image displaying device of the present invention may be basically similar to that of known field emission displays and the like. For example, drivers 718 and 719 can be attached to the lower electrode layer or emissive region of the electron-emitting element and to conductive gate layer 706, respectively, and a specific voltage applied to both layers.

EXAMPLES

The present invention is explained in more detail below using examples. However, the scope of the present invention is not limited by the examples.

Example 1

A polyimide sheet (brand name Kapton™, Toray-Dupont) with a thickness of 75 μm was used. For pre-baking the temperature was raised from room temperature at a heating speed of 4° C./min in an inactive gas atmosphere, and retained for 2 hours at 1100° C. in the carbonization region. For main baking the temperature was raised from room temperature at a heating speed of 20° C./min in an inactive gas atmosphere, and retained for 1 hour at 2700° C. in the graphitization temperature. After completion of main baking a graphite sheet was obtained by rolling. The thickness of this graphite sheet 101 was about 100 μm, thicker than that of the polyimide sheet (FIG. 1(*a*)).

Because this graphite sheet 101 was extremely flexible, it was easy to handle in the subsequent element preparation step. Moreover, it is desirable that it be fixed by means of an organic or inorganic adhesive to a flat plate so that it can be stably operated as an electron-emitting element. Therefore, in the present example, graphite sheet 101 was fixed to glass insulating substrate 102, which was cheap and extremely flat, by means of adhesive 103 having alumina as its main component (Aremco Ceramabond 503).

Next, Li ions were implanted into the graphite sheet at 200° C. under conditions of distribution within the range of 0.6 μm centering on the region of 0.4 μm in depth. Implantation was performed three times sequentially at 45 kV, 25 kV and 10 kV, in the amount of $1.5\times10^{16}$, $1.2\times10^{16}$ and $1.0\times10^{16}$ per 1 square cm, respectively. Observation of the structure near the surface by scanning electron microscopy revealed that bumpy structures 104 had been formed by ion implantation (FIG. 1(*b*)). Measurement of the distribution of Li atoms in the direction of depth by secondary ion mass spectroscopy (SIMS) revealed that the Li atoms were distributed roughly according to the conditions, and x-ray measurement confirmed that there were no changes in spacing in the graphite c-axial direction and that no interlayer compounds had formed.

Insulating layer 105 comprising a mixture of alumina powder and a binder was formed by screen printing. Conductive gate layer 106 comprising a mixture of fine silver particles and a binder was also formed by screen printing (FIG. 1(*c*)). The distances between graphite sheet 101 and conductive gate layer 106 and between neighboring conductive gates 106 were 350 μm and 500 μm, respectively.

When the positive and negative poles of a power source were connected to graphite sheet 101 and conductive gate layer 106, respectively, and voltage was applied, field emission began at 1.2 kV, exhibiting good field emission characteristics with little fluctuation in field emission current and little site-dependency. The results of measurement of field emission current relative to applied voltage are shown in FIG. 2.

Figure 2:
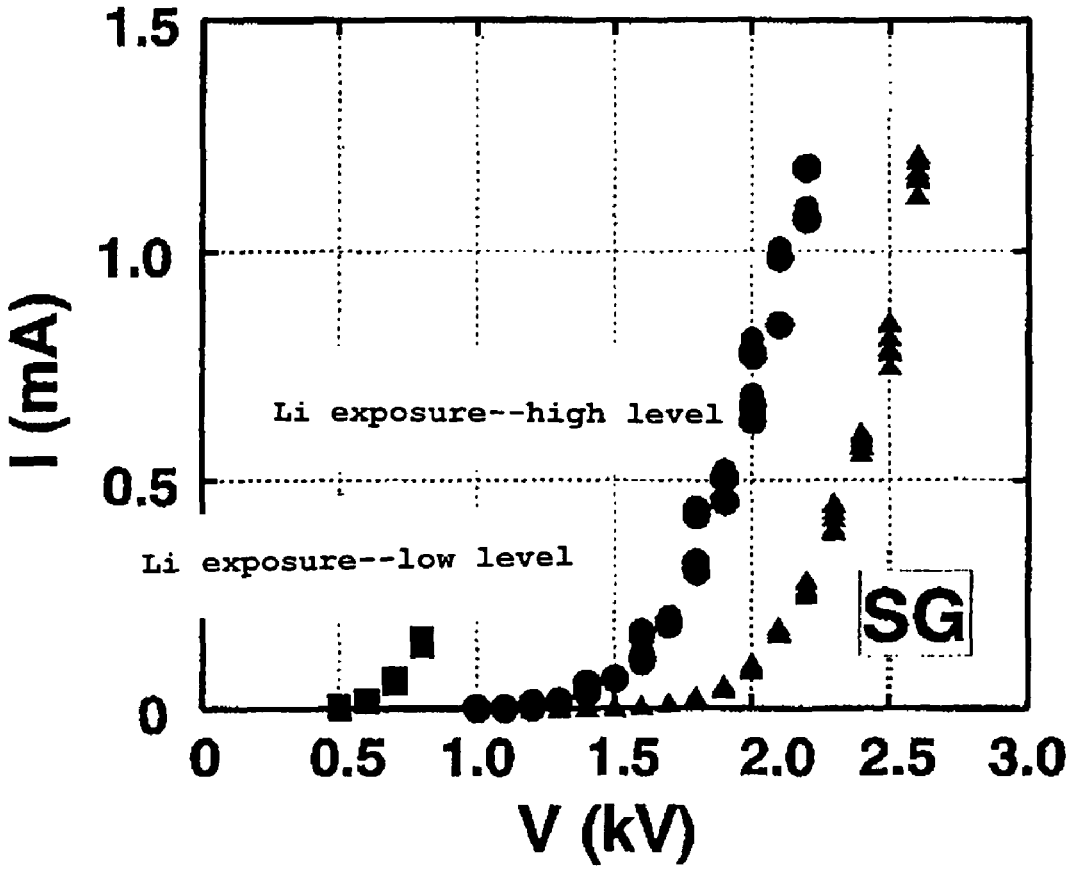
FIG. 2 shows the results of measurement of field emission current in the electron-emitting element of Example 1 of the present invention in response to applied voltage.

In FIG. 2, applied voltage (unit=kV) is plotted on the horizontal axis and current (unit=mA) on the vertical axis. "SG" indicates the measurement results when super-graphite (SG) which was not exposed to ions was used as the electron-emitting part, while "Li exposure—high level" indicates the measurement results for the present example.

In the electron-emitting element (the aforementioned "SG") having the same configuration as the aforementioned except that a graphite sheet with no implanted ions was used as the electron-emitting material, the field emission initiation voltage was about 1.7 kV, or about 0.5 kV lower. This value is equivalent to that obtained using carbon nanotubes as the electron-emitting material. These results show that the effect of Li ion implantation is extremely great in providing a high-performance electron-emitting element.

Figure 3:
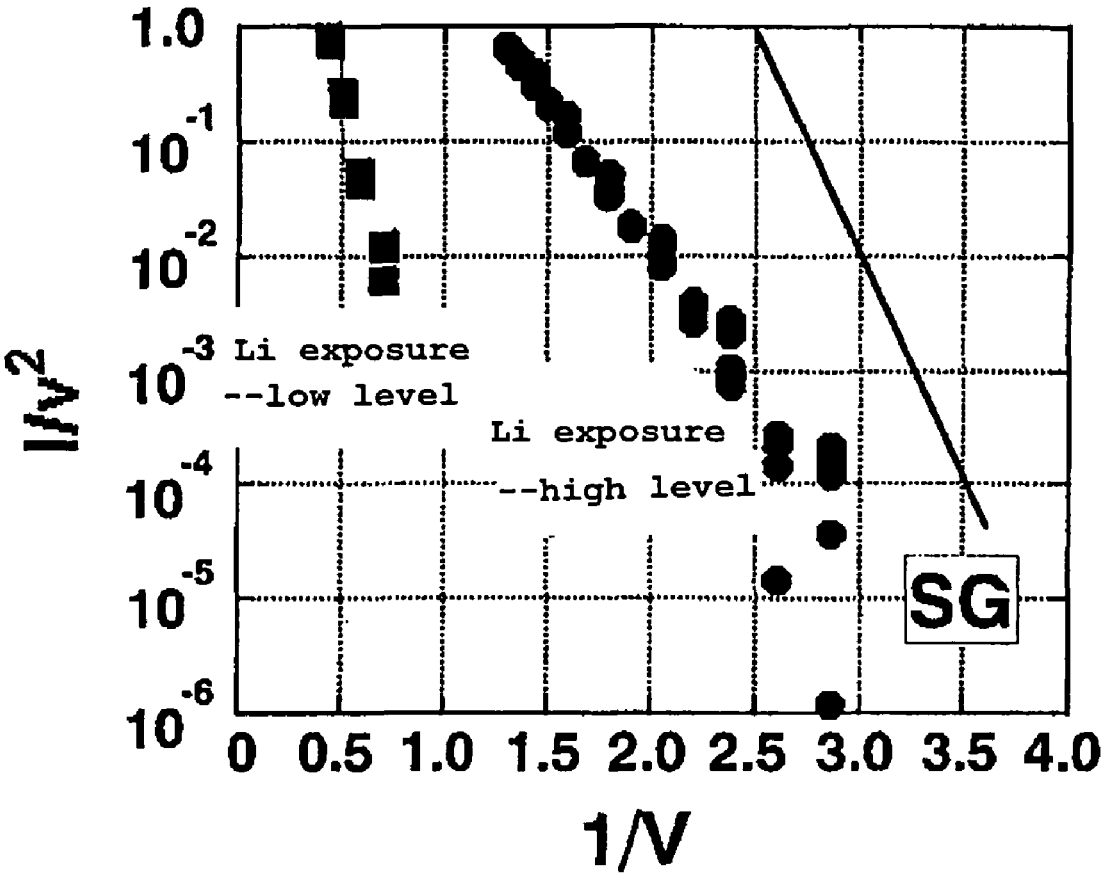
FIG. 3 shows the results from FIG. 2 as a Fowler-Nordheim plot.

The measurement results of FIG. 2 are shown as an FN (Fowler-Nordheim) plot in FIG. 3. The horizontal axis is the inverse of the field strength calculated from the applied voltage and gap length, while the vertical axis is the value derived by dividing the measured current by the square of the field strength. The slope of the graph indicates the size of the apparent work function, with a material which yields electrons easily having a smaller slope. The height of the vertical axis is proportional to the amount of current and is proportional to the density of the structure which contributes to electron emission.

As shown in FIG. 3, the work function with Li ion exposure was about 20% smaller than that of the graphite sheet without ion implantation (indicated by "SG" in FIG. 3). This decrease in work function is thought to reflect changes in surface electron states due to lithium atom implantation and the bumpy structures formed by ion exposure.

In FIGS. 2 and 3, results obtained when the amount of implanted ions was reduced to one-tenth of that for Li exposure—high level are shown as "Li exposure—low level". While the field emission initiation voltage is even lower than in the case of high-level Li exposure, the work function value is higher, roughly the same as that for the supergraphite sheet without implanted ions. These results seem to suggest that although the field emission initiation voltage decreases due to changes in surface states from ion exposure, there is little change in the work function because there is little Li near the surface. When the amount of Li ion exposure was reduced again to one-tenth, both the field emission initiation voltage and work function were virtually the same as that of the graphite sheet. Consequently, at least a certain amount of Li ions needs to be implanted in order to change the work function of a graphite sheet using Li ions. In the case of Li exposure—high concentration, the concentration of Li atoms in the graphite was about 0.06%, suggesting a lower limit of exposure of about 0.001%. The upper limit of exposure is thought to be about 3%.

The graphite sheet which is the base of the electron-emitting material can be obtained with a large area and uniform characteristics, making it easy to prepare a large-area, uniform electron-emitting element without any constraints in the step of preparing the element. As shown in FIG. 1(*d*), adjacent conductive gates 106 can be insulated from one another so that each element can be driven separately.

In addition, a fluorescent light-emitting device was prepared having fluorescent layer 109, which glows when exposed to electrons, arranged on transparent electrode 108, which is formed on glass substrate 107 facing the electron-emitting element. The fluorescent material used in the fluorescent layer can be selected according to the desired colors from phosphor materials such as ZnO: Zn, ZnS and the like which correspond to the energy values of the accelerated emitted electrons. In the present example, a ZnS was painted to form the fluorescent layer on a transparent conductive film (ITO) which was the acceleration electrode.

The fluorescent light-emitting device thus prepared was placed in a vacuum tank, electrons were extracted by application of voltage between gate layer 106 and graphite sheet 101, which was the electron-emitting material, and 3 kV of acceleration voltage was applied between transparent electrode 108, which functioned as the acceleration electrode, and the gate electrode of the electron-emitting element. A brightness of 300 to 400 cd/m$^2$ was obtained when the fluorescent emission brightness was measured. The strength of light emission can be controlled by adjusting the amount of current reaching the fluorescent body by means of the voltage applied between the gate electrode and electron-emitting material, or by adjusting the energy of electrons reaching the fluorescent body by means of the voltage between the acceleration electrode and the gate electrode.

Finally, by arranging several of these fluorescent light-emitting devices in two dimensions and controlling the luminescence of each individual fluorescent body it was possible to make a image displaying device which displayed a picture of any shape or brightness.

In Example 1, graphite sheet 101 was attached to substrate 102 before Li ion implantation, but similar results were obtained when ions were implanted directly into graphite sheet 101 before it was attached to substrate 102. Moreover, similar results were also obtained when Li ion implantation was performed after preparation of insulating layer 105 and conductive gate layer 106.

In addition, although Li was implanted in Example 1, similar results were obtained by implantation of at least one of the alkaline metals Li, Na, K, Cs and Rb and the alkaline earth metals Ca, Sr and Ba. In the case of nitrogen and oxygen, bumpy structures were formed, and the work function decreased slightly as they penetrated between the graphite layers or replaced or bound with the carbon atoms, thus changing the electron states. On the other hand when a noble gas such as He, Ne, Ar, Kr or Xe was implanted for example, field emission was initiated at low voltage because of the formation of bumpy structures, but there was less decrease in work function than when an alkaline metal or alkaline earth metal was implanted.

Similar effects produced when the implanted ions were not only atoms or molecules but clusters of these, and similar effect were produced even when the valence of the ions was changed. Similar effects were obtained when the temperature of the substrate during ion implantation was 1000° C. or less. Moreover, by performing treatment at a temperature of 1000° C. or less following ion implantation it was possible to promote chemical reactions between the graphite and the second element present near the surface, making the bumpy structures and compounds more uniform within the plane, and control or make uniform the concentration distribution of the atoms or molecules or clusters of these.

Graphite sheet 101 was bonded to glass insulating substrate 102, but a material with adequate mechanical strength could be used in place of insulating substrate 102 regardless of conductivity or material properties.

In Example 1, an adhesive having alumina as the main component was used to bond graphite sheet 102 to insulating substrate 105. Another adhesive can be used regardless of its conductivity or material properties as long as it is sufficiently adhesive.

In Example 1, it is sufficient that the temperature during pre-baking be over 1000° C. in order for the polyimide sheet to carbonize sufficiently, while the maximum temperature for main baking is preferably 2500° C. or more so that a graphite structure can develop sufficiently.

The heating speed and retention times differ depending on the maximum temperatures and the like for pre-baking and main baking and are not limited to the combinations of the present example.

The thickness of the polyimide film which is the starting raw material is not limited to 75 μm. For example, similar results were confirmed using commercial products in the range of 25 to 300 μm. Moreover, similar results were obtained when the thickness of the graphite sheet after baking was 10 μm or more.

When baking was performed with different heating speeds and retention times, particulate graphite was formed with a particle size of less than 1 mm rather than a sheet reflecting the shape of the raw material, but when the field emission characteristics were measured after ion exposure of this powder the results were similar to those obtained with a graphite sheet. Moreover, there was no effect of the binder or heat treatment on the electron emission characteristics of a regions where the ion-exposed powder was mixed with an inorganic or organic binder, applied and subjected to specific heat treatment. Similar results were also obtained with powdered graphite prepared by chopping or pulverization of a graphite sheet whether or not an element other than carbon was present.

Example 2

In this example, an electron-emitting element was prepared in the same way as in Example 1 except that a step of irradiating the graphite sheet with radical nitrogen was substituted for the Li ion implantation step, and the field emission characteristics were evaluated in the same way.

A boron nitride cylinder filled with nitrogen gas was irradiated with 200 W microwaves to produce highly reactive nitrogen radicals, and the nitrogen radicals were introduced through an opening at one end of the cylinder into a vacuum reaction container using differential pressure. The temperature of the graphite sheet within the reaction container was set to 950° C., and the surface of the graphite was exposed to $10^{22}$ of the nitrogen radicals per square cm.

X-ray measurement confirmed that no interlayer compounds had formed. Surface analysis confirmed the presence of nitrogen atoms and compounds of carbon and nitrogen near the surface. When the distribution of nitrogen atoms in the direction of depth was measured, the nitrogen atoms were found to be distributed at a maximum density of $10^{19}$ per cubic centimeter up to a depth of 1 μm.

The field emission characteristics were good when measured as in Example 1, with field emission initiated at 1.2 kV, little fluctuation in field emission current and little site-dependency. It is thought that the work function declined and electrons were emitted more easily due to penetration of the graphite by nitrogen or formation of compounds of carbon and nitrogen, so that field emission was initiated at a lower voltage.

In the present example, nitrogen was used as the radical source for irradiating the graphite sheet, but similar results were obtained when at least one of the alkaline metals Li, Na, K, Cs and Rb, the alkaline earth metals Ca, Sr and Ba and the noble gas elements Ne, Ar, Kr, and Xe was included. Similar results were also obtained when the radicals were not only atoms or molecules but clusters of these. Similar results were also obtained when the temperature of the substrate during radical exposure was 1000° C. or less. Moreover, by performing heat treatment at 1000° C. or less following radical exposure it was possible to promote chemical reaction of the graphite with the second element present near the surface, make compounds more uniform within the plane, and control or make uniform the concentration distribution of atoms or molecules or clusters of these in the direction of depth.

When oxygen radicals were used, moreover, if the substrate temperature was set at or above the sublimation temperature of the oxide the carbon atoms on the surface reacted with the oxygen and were desorbed from the surface as carbon monoxide or carbon dioxide. Since these reactions progressed preferentially from surface defects on the graphite surface, sharp bumpy structures were formed at high density. Consequently, the field emission initiation voltage was smaller than in the case of nitrogen radical irradiation.

Similar measurement results were obtained for field emission characteristics when pulverized graphite less than 1 mm in particle size was exposed to radicals. The electron emission characteristics were also similar from regions where this powder was mixed with inorganic and organic binders, applied and subjected to specific heat treatment. Similar results were also obtained using powdered graphite prepared by chopping or pulverization of a graphite sheet whether or not an element other than carbon was present.

Example 3

In Example 3, an electron-emitting element was prepared by the same steps as in Example 1 except that a step of exposing the graphite sheet to electrically neutral Cs metal was substituted for the step of implanting Li ions, and the field emission characteristics were evaluated in the same way.

Figure 4:
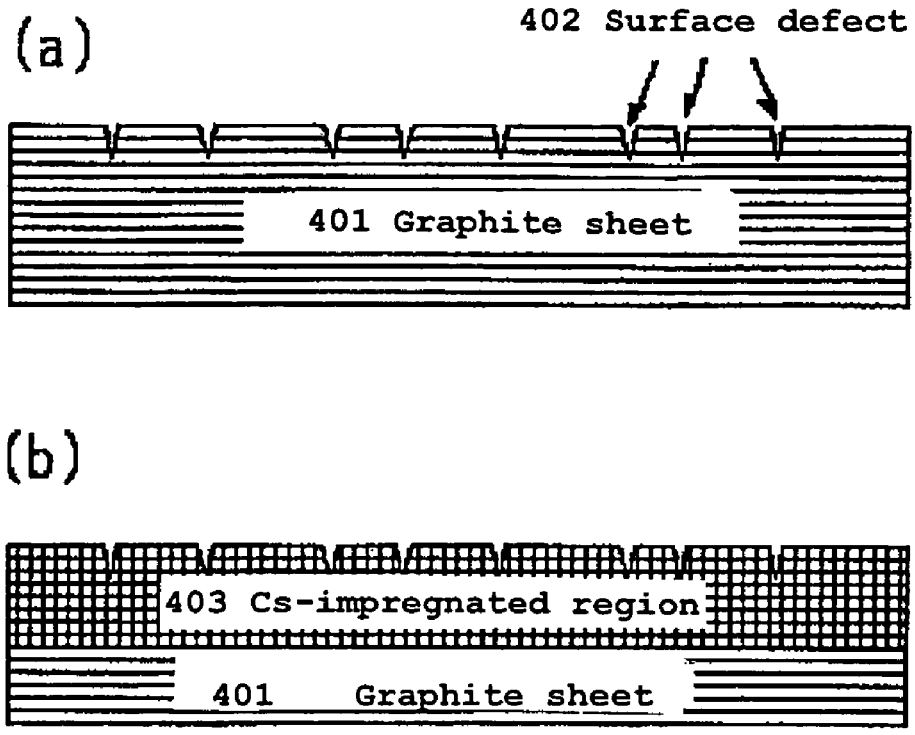
FIG. 4 is a process cross-section of the field-emission regions in the electron-emitting material and manufacturing method in Example 3 of the present invention.

As shown in FIG. 4(*a*), the surface of graphite sheet (401) before the step of impregnating the graphite sheet with Cs metal was roughly flat except for fine surface defects 402. In the graphite sheet (401) used in this example, which was prepared by baking a polymer sheet, the spacing between layers was extremely uniform. The domain size within a plane was smaller than that of highly oriented graphite (HOPG). Consequently, various surface defects which provide openings for atoms to penetrate the graphite are present at high densities.

Next, graphite sheet (401) was placed facing a crucible containing Cs metal in vacuum, and their respective temperatures were set to 350° C. and 194° C. Cs atoms vaporized from the crucible reached the graphite surface at a rate of $10^{16}$ per square centimeter, spreading out to penetrate between the layers of graphite through surface defects 402 and forming Cs-impregnated regions 403 (FIG. 4(*b*)).

X-ray measurement confirmed clearly that no interlayer compounds had formed. Surface analysis confirmed the presence of Cs atoms near the surface. The distribution of Cs atoms in the direction of depth was measured at a maximum of $10^{22}$ per 1 cubic cm up to 2 μm in depth.

The field emission characteristics were good when measured as in Example 1, with field emission initiated at 0.7 kV, little fluctuation in field emission current and little site-dependency. Since the bumpy structures were roughly the same before and after exposure to Cs atoms, it appears that the work function decreased and electron emission became easier due to impregnation or adsorption of Cs into the graphite, so that field emission was initiated at a lower voltage.

In the present example, Cs atoms were used as the neutral atoms for exposure of the graphite sheet, but similar results were obtained when at least one of nitrogen, oxygen, the alkaline metals Li, Na, K, Cs and Rb and the alkaline earth metals Ca, Sr and Ba was included. The same results were also obtained when exposure was not only to atoms or molecules but to clusters of these. Moreover, similar results were obtained when the temperature of the substrate during exposure to the neutral element was 1000° C. or less. In addition, by performing heat treatment at 1000° C. or less following exposure to the neutral element, it was possible to promote chemical reaction of the graphite with the element other than carbon present near the surface, make the bumpy structures and compounds more uniform in the plane, and make uniform or control the distribution of atoms or molecules or clusters of these in the direction of depth.

Similar measurement results were obtained for field emission characteristics when pulverized graphite less than 1 mm in particle size was exposed to the neutral element. Moreover, there was no effect of the binders or heat treatment on the field emission characteristics of regions where this powder was mixed with inorganic and organic binders, applied and subjected to specific heat treatment. Similar results were also obtained using powdered graphite prepared by chopping or pulverization of a graphite sheet whether or not an element other than carbon was present.

Example 4

In Example 4, an electron-emitting element was prepared by the same steps as in Example 3 except that the graphite sheet was irradiated with argon ions before the step of exposing it to electrically neutral Cs metal, and the field emission characteristics were evaluated in the same way.

As in Example 1, $4.5\times10^{16}$ argon ions per square cm were implanted at room temperature at an acceleration voltage of 180 kV into a graphite sheet fixed on a glass substrate. Next, the graphite sheet was impregnated with Cs metal using the same methods and conditions as in Example 3.

X-ray measurement confirmed clearly that no interlayer compounds had formed. Surface analysis confirmed the presence of Cs atoms and argon atoms near the surface. When the distribution of Cs atoms in the direction of depth was measured, they were found to be distributed at a maximum density of $10^{22}$ per 1 cubic cm up to a depth of 2 μm, while the argon atoms were distributed in the range of 0.2 μm centering around a depth of 0.25 μm.

When the field emission characteristics were measured as in Example 1, good field emission characteristics were found with field emission initiated at 0.4 kV, little fluctuation in field emission current and little site-dependency. When the argon ion exposure step, the Cs ion exposure step and the Cs atom impregnation step described in Example 3 were performed separately the field emission initiation voltages were 1.0 kV, 0.6 kV and 0.7 kV, respectively, so it was possible to further decrease the field emission initiation voltage by performing the Cs atom impregnation step after the argon ion exposure step. The concentration of Cs atoms near the surface was roughly the same, and since similar effects are obtained if the dose and kinetic energy of the ions are the same even if the type of ion is changed in the ion irradiation step, it is thought that it is easier for the Cs atoms to enter the graphite between graphite layers due to the bumpy structures formed in the ion irradiation step.

In this example, Cs atoms were used as the neutral atoms for exposing the graphite sheet, but the similar effects were obtained when at least one of the alkaline metals Li, Na, K, Cs and Rb and the alkaline earth metals Ca, Sr and Ba was included. Similar effects were also obtained when exposure was not only to atoms or molecules but to clusters of these. Similar effects were also obtained when the temperature of the substrate during exposure to neutral atoms was 1000° C. or less. In addition, by performing heat treatment at 1000° C. or less following exposure to the neutral element it was possible to promote chemical reaction of the graphite with the element other than carbon present near the surface, make the bumpy structures and compounds more uniform in the plane, and make uniform or control the distribution of atoms or molecules or clusters of these in the direction of depth.

Similar measurement results were obtained for field emission characteristics when pulverized graphite less than 1 mm in particle size was exposed to the neutral element. Moreover, there was no effect of the binders or heat treatment on the field emission characteristics of regions where this powder was mixed with inorganic and organic binders, applied and subjected to specific heat treatment. Similar results were also obtained using powdered graphite prepared by chopping or pulverization of a graphite sheet whether or not an element other than carbon was present.

Example 5

In this example, an electron-emitting element was prepared by the same steps as in Example 4 except that a step of exposing the graphite sheet to electrically neutral Mo metal was performed before the argon ion exposure step, and the field emission characteristics were evaluated in the same way.

Figure 5:
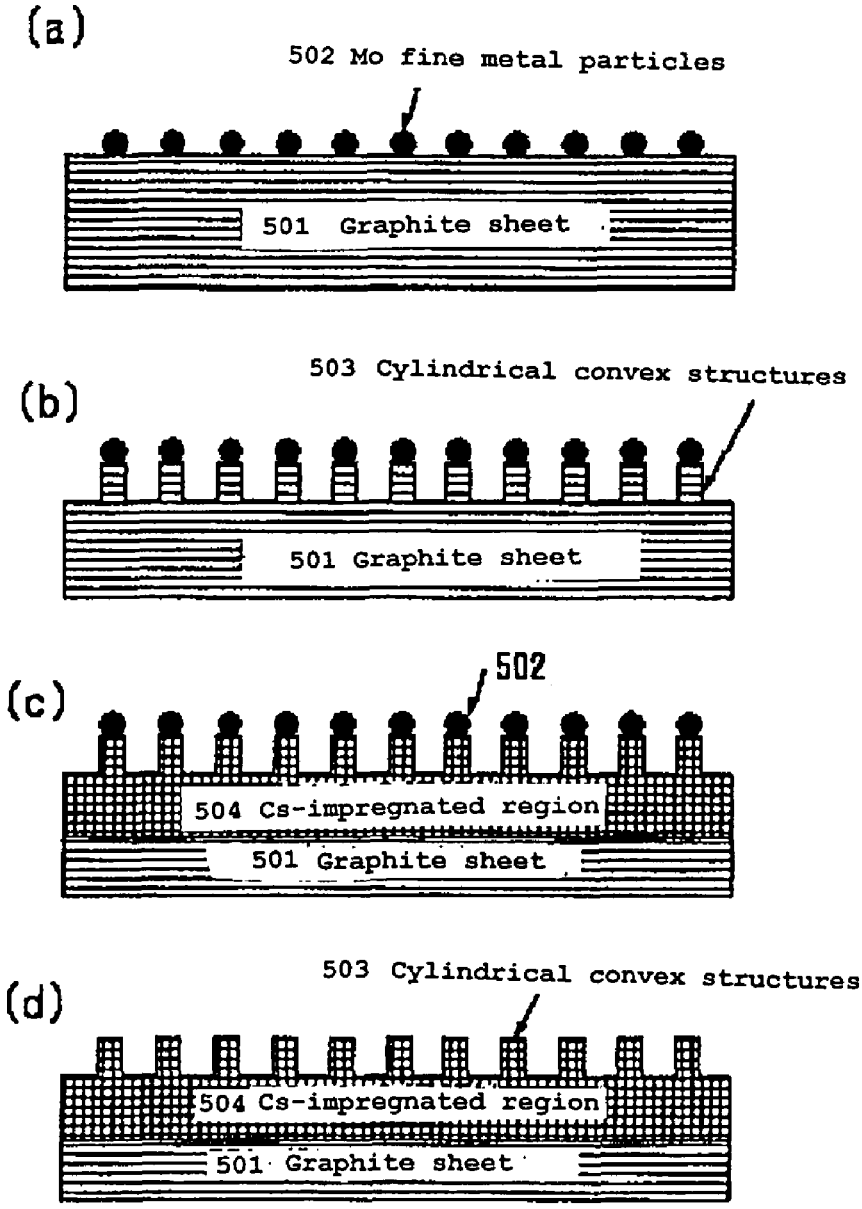
FIG. 5 is a process cross-section of the field-emission regions in the electron-emitting material and manufacturing method in Example 5 of the present invention.

A crucible containing Mo metal in vacuum was placed facing graphite sheet 501 which was fixed on a glass substrate prepared in the same manner as in Example 1, and the temperature of the graphite sheet was set to 500° C. Mo atoms vaporized from the crucible aggregated while expanding in surface area so that fine particles 502 of Mo metal formed uniformly on the surface of the graphite (FIG. 5 (*a*)). Next, argon ion exposure (FIG. 5 (*b*)) and Cs metal impregnation (FIG. 5 (*c*)) steps were performed in the same manner as in Example 4. In the argon ion exposure step, the Mo fine metal particles 502 acted as a mask so that the regions lacking Mo fine metal particle 502 were selectively etched (FIG. 5(*b*)), forming cylindrical convex structures 503. In the Cs metal impregnation step, the Cs atoms selectively penetrated the graphite from the sides of cylindrical convex structures 503, forming Cs impregnated region 504.

X-ray measurement confirmed clearly that no interlayer compounds had formed. Surface analysis also confirmed the presence of Mo atoms, Cs atoms and argon atoms near the surface. Measurement of the distribution of Cs atoms in the direction of depth showed that they were distributed at a maximum density of $10^{22}$ per 1 cubic cm up to a depth of 2 μm, while the argon atoms were distributed in the range of 0.2 μm centered around a depth of 0.25 μm.

Measurement of the field emission characteristics showed that as in Example 4, field emission was initiated at 0.4 kV, but the breadth of variation in field emission current and the site-dependency were much greater than in Example 4.

Moreover, the field emission characteristics from graphite sheet 501 before the argon ion exposure step and Cs metal impregnation step, although not as good as those with Cs metal impregnation, were better than those without the fine particles because of the formation of nanometer size structures on the surface at high densities. Because Mo fine metal particles 502 adhere by intermolecular force to Cs impregnated regions 504, they could be easily removed for example by ultrasound cleaning (FIG. 5 (*d*)). The field emission characteristics in this case were better than in the case of FIG. 5(*c*) because they were not influenced by the effect of Mo on work function.

Moreover, the size and density of the fine particles can be easily controlled by means of the substrate temperature and the amount of Mo atoms reaching the substrate per unit of time (flux density). Although Mo fine particles were used in this example, the type of metal is not limited as long as the etching speed in ion exposure step (b) is slower than the etching speed of the graphite. Even if it is faster than the etching speed of the graphite, fine particles are desirable that are classically capable of forming cylindrical convex structures 30 nm or more in height. In the present example metal is supplied to the surface of the substrate by vaporization, but fine particles could also be supplied by supplying an organic compound containing the specific metal and thermally decomposing it on the substrate.

In ion exposure step (b), exposure is to $4.5\times10^{16}$ argon ions per 1 square cm at room temperature at an acceleration voltage of 180 kV, but similar results were obtained with different ions as long as the kinetic energy and dose of the ions was roughly the same, and it is desirable that the dose be such as to allow formation of cylindrical convex structures roughly 30 nm or more in height.

In the present invention Cs atoms were used as the neutral atoms to which graphite sheet 501 was exposed, but similar results were obtained when at least one of the alkaline metals Li, Na, K, Cs and Rb and the alkaline earth metals Ca, Sr and Ba was included. Similar results were also obtained when exposure was not only to atoms or molecules but to clusters of these. Similar results were also obtained when the temperature of the substrate during exposure to the neutral atoms was 1000° C. or less. In addition, by performing heat treatment at 1000° C. or less following exposure to the neutral element it was possible to promote chemical reaction of the graphite with the element other than carbon present near the surface, make the bumpy structures or compounds more uniform in the plane, and make uniform or control the distribution of atoms or molecules or clusters of these in the direction of depth.

Similar measurement results were obtained for field emission characteristics when pulverized graphite less than 1 mm in particle size was exposed to the neutral element. Moreover, there was no effect of the binder or heat treatment on the field emission characteristics from regions in which this powder was mixed with inorganic and organic binders, applied and subjected to specific heat treatment. Similar results were also obtained using powdered graphite prepared by chopping or pulverization of a graphite sheet whether or not an element other than carbon was present.

Example 6

In this example, an electron-emitting element was prepared by the same steps as in Example 3 except that the graphite was exposed to oxygen radicals before the Cs metal impregnation deposition step, and the field emission characteristics were evaluated in the same way.

A boron nitride cylinder containing oxygen gas was irradiated with 400 W microwaves to produce oxygen radicals which were introduced into a vacuum reaction container from a hole in one end of the cylinder by means of differential pressure to expose a graphite sheet fixed to a glass substrate which was prepared in the same manner as in Example 3. The graphite sheet inside the reaction container was set to a temperature at or below the temperature at which oxides do not sublimate, and exposed to $10^{22}$ oxygen radicals per 1 square cm. Next, the Cs metal impregnation step was performed under the same conditions as in Example 3. X-ray measurement showed no formation of interlayer compounds, and surface analysis confirmed the presence of oxygen atoms and oxides of carbon near the surface.

When measured as in Example 3 the field emission characteristics were found to be better than in Example 3 or than in a case in which exposure was to oxygen radicals alone under the same conditions, with field emission initiated at 0.3 kV, little fluctuation in field emission current and little site-dependency. These results reflect an effective decline in work function due not only to penetration of the graphite by oxygen or formation of compounds of carbon and oxygen, but also to the dipole moment created when electrons move between oxygen, which has low electron affinity, and the Cs atoms, which are liable to positive ionization.

In the present example, oxygen was used as the radical source for exposing the graphite sheet, but similar effects were obtained when at least one of nitrogen, the alkaline metals Li, Na, K and Rb, the alkaline earth elements Ca, Sr and Ba and the noble gas elements Ne, Ar, Kr and Xe were included, although it is desirable that the difference in electronegativity of the element when present near the surface be large. Similar results were also obtained using not only atoms or molecules but also clusters of these. Similar results were also obtained when the temperature of the substrate during radical exposure was 1000° C. or less. In addition, by performing heat treatment at 1000° C. or less following radical exposure it was possible to promote chemical reaction of the graphite with the element other than carbon present near the surface, make the compounds more uniform in the plane, and make uniform or control the distribution of atoms or molecules or clusters of these in the direction of depth.

In the present example Cs atoms were used as the neutral element for exposing the graphite sheet, but similar results were obtained when at least one of the alkaline metals Li, Na, K, Cs and Rb and the alkaline earth metals Ca, Sr and Ba was included. Similar results were also obtained when exposure was not only to atoms or molecules but also to clusters of these. Similar results were also obtained when the temperature of the substrate during exposure to the neutral element was 1000° C. or less. In addition, by performing heat treatment at 1000° C. or less following exposure to the neutral element it was possible to promote chemical reaction of the graphite with the element other than carbon present near the surface, make the bumpy structures and compounds more uniform in the plane, and make uniform or control the distribution of atoms or molecules or clusters of these in the direction of depth.

Similar measurement results were obtained for field emission characteristics when pulverized graphite less than 1 mm in particle size was exposed to the neutral element. Moreover, there was no effect of the binder or heat treatment on the field emission characteristics from regions in which this powder was mixed with inorganic and organic binders, applied and subjected to specific heat treatment. Similar results were also obtained using powdered graphite prepared by chopping or pulverization of a graphite sheet whether or not an element other than carbon was present.

ADVANTAGES OF THE INVENTION

According to the present invention, it is possible to achieve improvements in electrical emission characteristics while taking advantage of the original properties of carbon material by contributing a second element to a graphite sheet (particularly the surface layer) in the form of atoms or molecules or clusters of these. That is, it is possible to provide an electron-emitting material wherein the carbon material provides superior electrical conductivity, thermal conductivity, corrosion resistance and the like while the field emission initiation voltage or work function is smaller than that of a conventional material. In this way, a highly efficient electron-emitting element, large-area display device or the like can be provided.

INDUSTRIAL APPLICABILITY

Application of the electron-emitting sheet material of the present invention is anticipated particularly to purposes for which electron-emitting materials have conventionally been used but also to a variety of other purposes. The electron-emitting sheet material of the present invention can be used favorably in displays, cathode ray tubes, emitters, lamps, electron guns and the like for example.

The invention claimed is:

1. A method for emitting electrons from an electron-emitting element comprising an electron-emitting sheet material, a conductive gate layer, and an insulating layer, wherein the electron-emitting sheet material comprises a substrate and a graphite sheet laminated on the top of the substrate, and wherein (1) the graphite sheet has a layered structure of layers of graphenes consisting of a plurality of carbon hexagonal networks, (2) the graphenes are layered relative to one another so that the c-axial direction of each graphene is substantially perpendicular to the plane of the substrate, (3) the graphite sheet is laminated on the substrate so that the c-axial direction of each graphene is substantially perpendicular to the plane of the substrate, and (4) the graphite sheet comprises an element other than carbon as a second element, and wherein the graphite sheet and conductive gate layer are arranged with an insulating layer therebetween;

the method comprising the step of:

emitting electrons from the electron-emitting element by generating a potential difference between the graphite sheet and the conductive gate layer.

2. The method for emitting electrons from an electron-emitting element according to claim 1, wherein the x-ray diffraction pattern of the graphite sheet has (002″) plane peaks, wherein n is a natural number.

3. The method for emitting electrons from an electron-emitting element according to claim 1, wherein the x-ray diffraction pattern of the graphite sheet has (002) plane and (004) plane peaks.

4. The method for emitting electrons from an electron-emitting element according to claim 1, wherein the second element is present between the layers of graphenes.

5. The method for emitting electrons from an electron-emitting element according to claim 1, wherein the concentration of the second element is from 0.001 atomic % to 3 atomic %.

6. The method for emitting electrons from an electron-emitting element according to claim 1, wherein the concentration of the second element is from 0.005 atomic % to 2 atomic %.

7. The method for emitting electrons from an electron-emitting element according to claim 1, wherein the concentration of the second element is from 0.01 atomic % to 1 atomic %.

8. The method for emitting electrons from an electron-emitting element according to claim 1, wherein the thickness of the sheet is from 10 μm to 1000 μm.

9. The method for emitting electrons from an electron-emitting element according to claim 1, wherein some or all of the second element is present in the surface layer between the surface of the electron-emitting sheet material and a depth of 10% of the thickness of the electron-emitting sheet material.

10. The method for emitting electrons from an electron-emitting element according to claim 1, wherein the second element is at least one of an alkaline metal element and an alkaline earth metal element.

11. The method for emitting electrons from an electron-emitting element according to claim 1, wherein the second element is at least one of Li, Na, K, Cs, Rb, Ca, Sr and Ba.

12. The method for emitting electrons from an electron-emitting element according to claim 1, wherein the second element is at least one of nitrogen and oxygen.

13. The method for emitting electrons from an electron-emitting element according to claim 1, wherein the second element is at least one kind of noble gas element.

14. The method for emitting electrons from an electron-emitting element according to claim 1, wherein the second element is at least one of Ne, Ar, Kr and Xe.

15. The method for emitting electrons from an electron-emitting element according to claim 1, wherein the second element is a combination of two or three elements selected from 1) through 3) below:

1) at least one of an alkaline metal element and an alkaline earth metal element, 2) at least one of nitrogen and oxygen, and 3) at least one kind of noble gas element.

16. A method for emitting electrons from an electron-emitting element comprising an electron-emitting sheet material, a conductive gate layer, and an insulating layer, wherein the electron-emitting element comprises a substrate and a graphite sheet laminated on the top of the substrate, wherein, (1) the graphite sheet has a layered structure of layers of graphenes consisting of a plurality of carbon hexagonal networks, (2) the graphenes are layered relative to one another so that the c-axial direction of each graphene is substantially perpendicular to the plane of the substrate, (3) the graphite sheet is laminated on the substrate so that the c-axial direction of each graphene is substantially perpendicular to the plane of the substrate, the electron-emitting sheet material is obtained by imparting a second element other than carbon to the graphite sheet in the form of atoms, molecules or clusters, and the graphite sheet and conductive gate layer are arranged with an insulating layer therebetween;

the method comprising the step of:

emitting electrons from the electron-emitting element by generating a potential difference between the graphite sheet and the conductive gate layer.

17. The method for emitting electrons from an electron-emitting element according to claim 16, which comprises a step of heat treating the graphite sheet after the step of imparting a second element.

18. The method for emitting electrons from an electron-emitting element according to claim 16, wherein the step of imparting a second element comprises:

a) an ion implantation step of implanting at least one of ionized atoms, molecules and clusters as the second element in the graphite sheet.

19. The method for emitting electrons from an electron-emitting element according to claim 16, wherein the step of imparting a second element comprises b) a radical irradiation step of irradiating the graphite sheet with at least one of radicalized atoms, molecules and clusters as the second element.

20. The method for emitting electrons from an electron-emitting element according to claim 16, wherein the step of imparting a second element comprises c) a deposition step of depositing at least one of electrically neutral substance in the form of atoms, molecules and clusters as the second element on the graphite sheet.

21. The method for emitting electrons from an electron-emitting element according to claim 16, wherein the step of imparting a second element has two or three of the following steps a) through c):

a) an ion implantation step of implanting at least one of ionized atoms, molecules and clusters as the second element in the graphite sheet;

b) a radical irradiation step of irradiating the graphite sheet with at least one of radicalized atoms, molecules and clusters as the second element; and c) a deposition step of depositing at least one of electrically neutral substance in the form of atoms, molecules and clusters as the second element on the graphite sheet.

22. The method for emitting electrons from an electron-emitting element according to claim 16, wherein the graphite sheet is obtained by heat-treatment of a polymer sheet.

23. The method for emitting electrons from an electron-emitting element according to claim 22, wherein the polymer sheet is at least one of polyphenylene oxadiazole, polybenzothiazole, polybenzobisthiazole, polybenzoxazole, polybenzobisoxazole, polythiazole, polyamide, polyimide, polyamide-imide and polyacrylonitrile.

24. The method for emitting electrons from an electron-emitting element according to claim 22, wherein the polymer sheet is polyimide.

25. The method for emitting electrons from an electron-emitting element according to claim 22, wherein the polymer sheet is aromatic polyimide.

26. The method for emitting electrons from an electron-emitting element according to claim 22, wherein the heat treatment comprises a first heat treatment step of heating in inactive gas from a first initial temperature at a first heating rate and baking at a temperature of not less than 1000° C. and less than 2500° C., and a second heat treatment step of heating after the first heat treatment step in inactive gas from a second initial temperature at a second heating rate and baking at a temperature of 2500° C. or more.

27. The method for emitting electrons from an electron-emitting element according to claim 16, wherein the x-ray diffraction pattern of the graphite sheet has) (002$^n$) plane peaks, wherein n is a natural number.

28. The method for emitting electrons from an electron-emitting element according to claim 16, wherein the x-ray diffraction pattern of the graphite sheet has (002) plane and (004) plane peaks.

29. The method for emitting electrons from an electron-emitting element according to claim 16, wherein the second element is present between the layers of graphenes.

30. The method for emitting electrons from an electron-emitting element according to claim 16, wherein the concentration of the second element is from 0.001 atomic % to 3 atomic %.

31. The method for emitting electrons from an electron-emitting element according to claim 16, wherein the concentration of the second element is from 0.005 atomic % to 2 atomic %.

32. The method for emitting electrons from an electron-emitting element according to claim 16, wherein the concentration of the second element is from 0.01 atomic % to 1 atomic %.

33. The method for emitting electrons from an electron-emitting element according to claim 16, wherein the thickness of the sheet is from 10 μm to 1000 μm.

34. The method for emitting electrons from an electron-emitting element according to claim 16, wherein some or all of the second element is present in the surface layer between the surface of the electron-emitting sheet material and a depth of 10% of the thickness of the electron-emitting sheet material.

35. The method for emitting electrons from an electron-emitting element according to claim 16, wherein the second element is at least one of an alkaline metal element and an alkaline earth metal element.

36. The method for emitting electrons from an electron-emitting element according to claim 16, wherein the second element is at least one of Li, Na, K, Cs, Rb, Ca, Sr and Ba.

37. The method for emitting electrons from an electron-emitting element according to claim 16, wherein the second element is at least one of nitrogen and oxygen.

38. The method for emitting electrons from an electron-emitting element according to claim 16, wherein the second element is at least one kind of noble gas element.

39. The method for emitting electrons from an electron-emitting element according to claim 16, wherein the second element is at least one of Ne, Ar, Kr and Xe.

40. The method for emitting electrons from an electron-emitting element according to claim 16, wherein the second element is a combination of two or three elements selected from 1) through 3) below:

1) at least one of an alkaline metal element and an alkaline earth metal element, 2) at least one of nitrogen and oxygen, and 3) at least one kind of noble gas element.

* * * * *

UNITED STATES PATENT AND TRADEMARK OFFICE

CERTIFICATE OF CORRECTION

PATENT NO. : 7,736,542 B2
APPLICATION NO. : 11/047656
DATED : June 15, 2010
INVENTOR(S) : Motoshi Shibata et al.

It is certified that error appears in the above-identified patent and that said Letters Patent is hereby corrected as shown below:

Specifically, in the Claims Section, column 28, line 3 reads, diffraction pattern of the graphite sheet has) ($002^{n}$) plane..., it should read, diffraction pattern of the graphite sheet has ($002^{n}$) plane...

Signed and Sealed this
Twenty-second Day of March, 2011

David J. Kappos

David J. Kappos
*Director of the United States Patent and Trademark Office*